US006351177B1

(12) United States Patent
Lin et al.

(10) Patent No.: US 6,351,177 B1
(45) Date of Patent: Feb. 26, 2002

(54) PROGRAMMABLE AND INPUT VOLTAGE INDEPENDENT REFERENCE VOLTAGE GENERATOR

(75) Inventors: Yue-Zen Lin, Hsinchu; Chien-Kuo Wang, Taoyuan Hsien; Chung-Chin Huang, Hsinchu, all of (TW)

(73) Assignee: Macronix International Co., Ltd., Hsinchu (TW)

( * ) Notice: Subject to any disclaimer, the term of this patent is extended or adjusted under 35 U.S.C. 154(b) by 0 days.

(21) Appl. No.: 09/706,263

(22) Filed: Nov. 3, 2000

(30) Foreign Application Priority Data

Jun. 7, 2000 (TW) ..... 89111021 A

(51) Int. Cl.[7] ..... G05F 1/10
(52) U.S. Cl. ..... 327/540; 327/541; 323/315
(58) Field of Search ..... 327/530, 538–543; 323/315–317

(56) References Cited

U.S. PATENT DOCUMENTS 5,825,167 A * 10/1998 Ryat ..... 323/315

* cited by examiner

*Primary Examiner*—Kenneth B. Wells
(74) *Attorney, Agent, or Firm*—J. C. Patents

(57) ABSTRACT

A programmable and input voltage independent reference voltage generator. Size of reference voltage can be adjusted by controlling size of current using current mirrors and MOS switches. No decoding circuit is necessary. By adjusting the resistance value, current mirror and dimensional ratio of MOS, a chip area smaller than a decoding circuit can be used to accommodate the reference voltage generator. The reference voltage generator is able to provide an adjustable and stable reference voltage to different types of electronic modules. By providing a highly flexible reference voltage, performance of any circuits using the generator is boosted.

10 Claims, 2 Drawing Sheets

PROGRAMMABLE AND INPUT VOLTAGE INDEPENDENT REFERENCE VOLTAGE GENERATOR

CROSS-REFERENCE TO RELATED APPLICATION

This application claims the priority benefit of Taiwan application serial no. 89111021, filed Jun. 7, 2000.

BACKGROUND OF THE INVENTION

1. Field of Invention

The present invention relates to a reference voltage generator. More particularly, the present invention relates to a programmable reference voltage generator capable producing a reference voltage relatively independent from any fluctuation in input voltage source.

2. Description of Related Art

Most devices inside an electronic module need a reference voltage to serve as source for driving, comparing or triggering whatever operations necessary. However, turning on an electronic module may produce a transient voltage surge and temperature may rise after running the module for awhile. All these factors may lead to some variation in the reference voltage. In other words, the reference voltage may fluctuate according to changes in the input voltage and may lead to system instability or circuit failure.

SUMMARY OF THE INVENTION

Accordingly, one object of the present invention is to provide a programmable and input voltage independent reference voltage generator. The reference voltage generator comprises of a bandgap generation circuit, two amplifiers, two variable current sources, six PMOS transistors, five NMOS transistors and four resistors. The bandgap generation circuit provides an operating voltage. Both the negative terminal of the first amplifier and the positive terminal of the second amplifier receive the operating voltage from the bandgap generation circuit. The negative terminal of the second amplifier is connected to a first node point and the output terminal of the second amplifier is connected to a second node point. The source terminal of the first PMOS transistor is connected to a voltage source. The gate terminal of the first PMOS transistor is connected to the output terminal of the first amplifier. The drain terminal of the first PMOS transistor is connected to the positive input terminal of the first amplifier. The source terminal and the substrate of the second PMOS transistor are connected to a voltage source. The gate terminal of the second PMOS transistor is connected to the output terminal of the first amplifier. The source terminal and the substrate of the third PMOS transistor are connected to the voltage source. The gate terminal and the drain terminal of the third PMOS transistor are coupled to each other. The source terminal and the substrate of the fourth PMOS transistor are connected to the voltage source. The gate terminal of the fourth PMOS transistor is connected to the gate terminal of the third PMOS transistor. The source terminal and the substrate of the fifth PMOS transistor are connected to the voltage source. The gate terminal and the drain terminal of the fifth PMOS transistor are coupled to each other. The source terminal and the substrate of the sixth PMOS transistor are connected to the voltage source. The gate terminal of the sixth PMOS transistor is connected to the drain terminal of the fifth MOS transistor. The drain terminal of the sixth PMOS transistor is connected to a fourth node point.

The source terminal and the substrate of the first NMOS transistor are connected to a ground voltage. The gate terminal and the drain terminal of the first NMOS transistor are coupled to each other and connected to the drain terminal of the second PMOS transistor. The source terminal and the substrate of the second NMOS transistor are connected to the ground voltage. The gate terminal of the second NMOS transistor is connected to the gate terminal of the first NMOS transistor. The drain terminal of the second NMOS transistor is connected to the drain terminal of the third PMOS transistor. The source terminal and the substrate of the third NMOS transistor are connected to the ground voltage. The gate terminal and the drain terminal of the third NMOS transistor are connected to each other and to the drain terminal of the fourth PMOS transistor. The source terminal and the substrate of the fourth NMOS transistor are connected to the ground voltage. The gate terminal of the fourth NMOS transistor is connected to the gate terminal of the third NMOS transistor. The drain terminal of the fourth NMOS transistor is connected to the drain terminal of the fifth PMOS transistor. The source terminal and the substrate of the fifth NMOS transistor are connected to the ground voltage. The gate terminal of the fifth NMOS transistor is connected to the gate terminal of the fourth NMOS transistor. The drain terminal of the fifth NMOS transistor is connected to the third node point. The input terminal of the first variable current source is connected to the voltage source. The output terminal of the first variable current source is connected to the drain terminal of the fourth PMOS transistor. The input terminal of the second variable current source is connected to the voltage source. The output terminal of the second variable current source is connected to the fourth node point. The first resistor connects between the positive terminal of the first amplifier and ground. The second resistor connects between the first node point and the second node point. The third resistor connects between the first node point and the third node point. The fourth resistor connected between the fourth node pint and the ground. The first, second, third and fourth node point are used for outputting a first, second, third and fourth reference voltage respectively.

The programmable and input voltage independent reference voltage generator of this invention uses a current mirror and a plurality of MOS switches to control size of current so that size of the reference voltage can be adjusted. According to this invention, no decoding circuits are employed. By adjusting values of resistors and dimensional ratio between the current mirror and MOS, a relatively small circuit area (for example, smaller than a decoding circuit) is needed to house the voltage generator circuit. In addition, the invention is able to provide an adjustable but highly stable reference voltages to electronic modules such as A/D or D/A converters or clamping circuits. Hence, performance of application circuits can be optimized through the highly flexible generation method used by the reference voltage generator.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
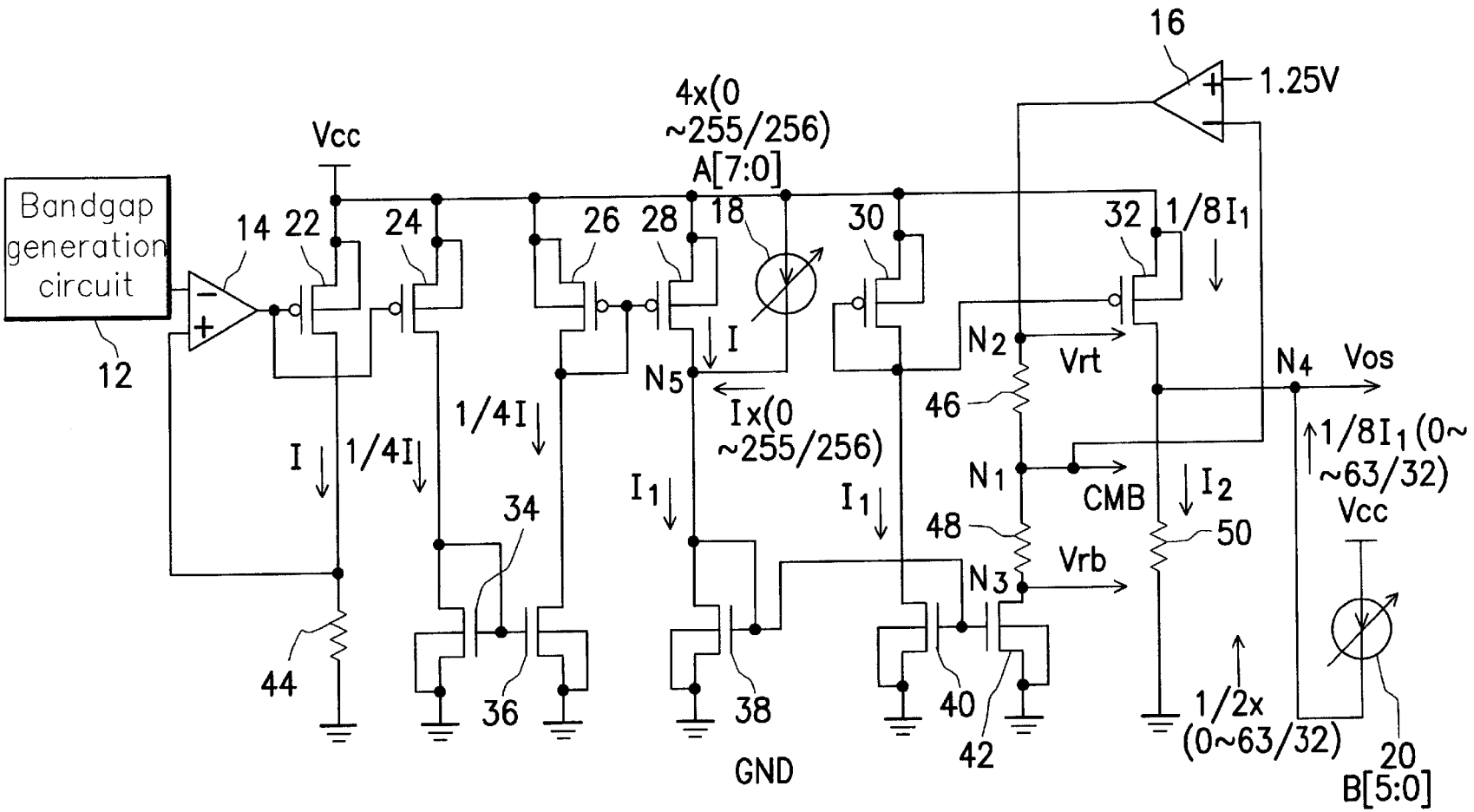
FIG. 1 is a diagram showing the circuit of a programmable and input voltage independent reference voltage generator according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a diagram showing the circuit of a programmable and input voltage independent reference voltage generator according to one preferred embodiment of this invention.

As shown in FIG. 1, the reference voltage generator 10 comprises of a bandgap generation circuit 12, two amplifiers 14 and 16, two variable current sources 18 and 20, six PMOS transistors 22, 24, 26, 28, 30 and 32, five NMOS transistors 34, 36, 38, 40 and 42, and four resistors 44, 46, 48 and 50.

Bandgap generation circuit 12 provides an operating voltage, for example 1.25V. The negative input terminal of amplifier 14 receives the operating voltage from bandgap generation circuit 12. The positive input terminal of amplifier 14 is connected to the drain terminal of PMOS transistor 22. The output terminal of amplifier 14 is gate terminal of PMOS transistor 22. The positive input terminal of amplifier 16 receives the operating voltage from bandgap generation circuit 12. The negative input terminal of amplifier 16 is connected to a node point N1 and the output terminal of amplifier 16 is connected to a node point N2.

The source terminal and the substrate of PMOS transistor 22 are connected to a voltage source VCC. The gate terminal of PMOS transistor 22 is connected to the gate terminal of PMOS transistor 24. The source terminal and the substrate of PMOS transistor 24 are connected to the voltage source VCC. The drain terminal of PMOS transistor 24 is connected to the drain terminal of NMOS transistor 34. The source terminal and the substrate of PMOS transistor 26 are connected to a voltage source VCC. The gate terminal and the drain terminal of PMOS transistor 26 are coupled to each other as well as the gate terminal of PMOS transistor 28 and the drain terminal of NMOS transistor 36. The source terminal and the substrate of PMOS transistor 28 are connected to the voltage source VCC. The drain terminal of PMOS transistor 28 is connected to the output terminal of variable current source 18. The source terminal and the substrate of PMOS transistor 30 are connected to the voltage source VCC. The gate terminal and the drain terminal of PMOS transistor 30 are coupled to each other as well as the gate terminal of PMOS transistor 32 and the drain terminal of NMOS transistor 40. The source terminal and the substrate of PMOS transistor 32 are connected to the voltage source VCC. The drain terminal of PMOS transistor 32 is connected to a node point N4.

In addition, the source terminal and the substrate of NMOS transistor 34 are connected to a voltage ground GND. The gate terminal and the drain terminal of NMOS transistor 34 are coupled to each other as well as the gate terminal of NMOS transistor 36. The source terminal and the substrate of NMOS transistor 36 are connected to the ground GND. The source terminal and the substrate of NMOS transistor 38 are connected to ground GND. The gate terminal and the drain terminal of NMOS transistor 38 are connected to ground GND. The gate terminal and the drain terminal of NMOS transistor 38 are coupled to each other as well as the output terminal of variable current source 18 and the gate terminal of NMOS transistors 40 and 42. The source terminal and the substrate of NMOS transistor 40 are connected to ground GND. The source terminal and the substrate of NMOS transistor 42 are connected to ground GND. The source terminal and the substrate of NMOS transistor 42 are connected to ground GND. The drain terminal of NMOS transistor 42 is connected to a node point N3. The input terminal of variable current source 18 is connected to the voltage source VCC. The output terminal of variable current source 18 is connected to the drain terminal of PMOS transistor 28. The input terminal of variable current source 20 is connected to the source voltage VCC. The output terminal of variable current source 20 is connected to node point N4. The terminals of resistor 44 connect to the positive input terminal of amplifier 14 and ground GND respectively. The terminals of resistor 46 connect to node point N1 and node point N2 respectively. The terminals of resistor 48 connect to node point N1 and node point N3 respectively. The terminals of resistor 50 connect to node point N4 and ground GND respectively. Node point N1 is used for outputting a first reference voltage CMB. Node point N2 is used for outputting a second reference voltage Vrt. Node point N3 is used for outputting a third reference voltage Vrb. Node point N4 is used for outputting a fourth reference voltage Vos.

In this embodiment, dimensional ratio between PMOS transistor 22 and 24 is 4:1 and dimensional ratio between PMOS transistor 30 and 32 is 4:½. In addition, dimensional ratio between NMOS transistor 34 and 36 is 1:1 and dimensional ratio for NMOS transistors 38, 40 and 42 is 4:4:1. Resistor 44 has a resistance value of about 25 KΩ. Resistors 48 and 48 have a resistance value of about 20 KΩ. Resistor 50 has a resistance value of about 20 KΩ. Obviously, the invention is not limited to the said dimensional ratios and resistance values. In other words, various PMOS transistors, NMOS transistors and resistors can have dimensions and resistance values other than the ones stated before as long as the spirit of this invention is met.

In FIG. 1, using node point 5 to illustrate, when A[7:0]=00000000, $I_1=I+0$; and when A[7:0]=11111111, $I_1+I(255/256)$, which is close to 2I.

Similarly, using node point 4 to illustrate, when B[5:0]=000000, $I_2=(1/8)I_1+0$; when B[5:0]=100000, $I_2=(1/8)I_1+(1/8)I_1$, and when B[5:0]=111111, $I_2=(1/8)I_1+(1/8)I_1\times 63/32$, which is close to $(1/8)I_1+(1/4)I_1$.

In application, the fourth reference voltage Vos can be set to the mid-point of signal, that is, an analog ground. The adjustment of Vos is used mainly to compensate for amplifier generated offset.

Operating method of the reference voltage generator can be illustrated by referring to supplementary table no. 1 and table no. 2.

First, code for A[7:0] is set. After setting A[7:0]=00000000~11111111, Vrt−Vrb=0.5V~1.0V is obtained. The value of Vrt−Vrb represents full swing of signal.

After setting the value of Vrt−Vrb, code for B[5:0] is set. In general, Vos=(Vrt−Vrb)/2 or the analog ground is first set. If there is any offset, Vos can be finely adjusted by setting B[5:0] to compensate for the offset.

The method of this invention can be applied to the A/D converter or the D/A converter within a video control IC. By tuning the value of Vrt−Vrb, the contrast of an image will be adjusted. On the other hand, tuning Vos will adjust the brightness level of an image. Furthermore, CMB voltage is pegged through a virtual short of the amplifier. Hence, CMB voltage is suitable for a system that requires a mid-point reference voltage or an analog ground (such as A/D or D/A).

The values (Vrt−Vrb and Vos) in supplementary tables no. 1 and no. 2 can be computed using the following formulae:

$$\text{Formula 1: } Vrt - Vrb = \frac{1.25\text{ V}}{25\text{ K}\Omega} \times \frac{1}{4} \times 4 \times \left[1 + \left(0 \sim \frac{255}{256}\right)\right] \times \frac{1}{4} \times 40\text{ K}\Omega;$$

$$\text{Formula 2: } Vos = \frac{1.25\text{ V}}{25\text{ K}\Omega} \times \frac{1}{4} \times 4 \times \left[1 + \left(0 \sim \frac{255}{256}\right)\right] \times \frac{1}{8} \times \left[1 + \left(0 \sim \frac{63}{32}\right)\right] \times 20\text{ K}\Omega;$$

Formula 3: A0~A7 decodes 0~255/256 (0~255),

B0~B5 decodes 0~63/32 (−31~0~+31);

where 1.25V is the preset operating voltage provided by bandgap generation circuit 12, 25 KΩ is the preset value of resistor 44, 40 KΩ is the sum of the resistance of resistors 46 and 48 (for example, 20 KΩ(preset value of resistor 46)+20 KΩ(preset value of resistor 48), and 20 KΩ is the preset value of resistor 50. Moreover, CMB=1.25V (fixed), CMB=(Vrt−Vrb)/2.

SUPPLEMENTARY TABLE NO. 1

| Programming 8-bit code A0~A7 to obtain: | | | |
|---|---|---|---|
| \Code | 00 | ~ | FF |
| Vrt-Vrb | 0.5 V | ~ | 1.0 V |

SUPPLEMENTARY TABLE NO. 2

| Programming 6-bit code B0~B5 to obtain: | | | |
|---|---|---|---|
| Code\Vos\Vrt-Vrb | 0.5 V | ~ | 1.0 V |
| 3F | 0.375 V | ~ | 0.750 V |
| 1F | 0.250 V | ~ | 0.50 V |
| 00 | 0.125 V | ~ | 0.250 V |

In the supplementary tables Nos. 1 & 2, a power source supplies a voltage of between 3.0V to 3.6V and the operating temperature is between 25° C. to 100° C.

According to formula 1 and 2, the reference voltages can be obtained as long as the resistance of two resistors has a matching ratio. There is no need to use resistors with highly accurate resistance values. Moreover, the reference voltages are independent of power source voltage and ambient temperature (1.25V is supplied by bandgap generation circuit 12).

Figure 2:
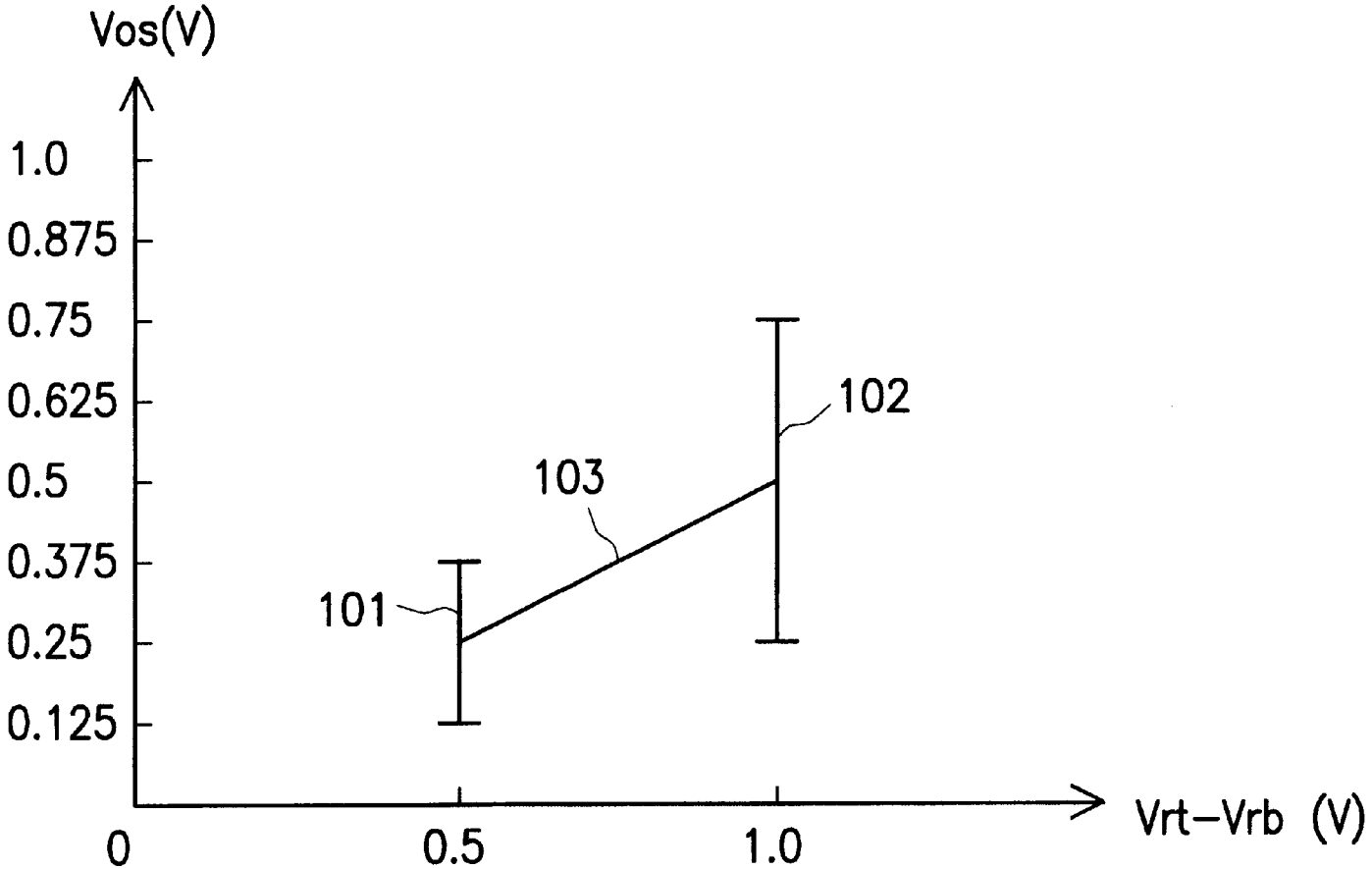
FIG. 2 is a graph showing the relationship between Vrt−Vrb and Vos according to the reference voltage generator of this invention.

In addition, the relationship between Vrt−Vrb and Vos can be obtained from supplementary tables nos. 1 and 2. FIG. 2 is a graph showing the relationship between Vrt−Vrb and Vos according to the reference voltage generator of this invention. As shown in FIG. 2, when Vrt−Vrb is equal to 0.5V, the variation of voltage is between 0.125V~0.375V shown by the straight line 101. When Vrt−Vrb is equal to 1.0V, the variation of voltage is between 0.25~0.75V shown by the straight line 102. The straight line labeled 103 represents the mid-point of Vos signal. Vos signal can be adjusted and hence can be used for compensating any offset produced by an amplifier.

In summary, the programmable and fluctuation-free reference voltage generator has the following advantages including:

(1) Size of reference voltage can be adjusted by controlling size of current using current mirrors and MOS switches.

(2) No decoding circuit is necessary. By adjusting the resistance value, current mirror and dimensional ratio of MOS, a chip area smaller than a decoding circuit can be used to accommodate the reference voltage generator.

(3) The reference voltage generator is able to provide an adjustable and stable reference voltage to different types of electronic modules including AID or D/A converter, clamping circuit and so on.

(4) Since the generator is able to provide a highly flexible reference voltage, performance of circuits using the system is boosted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A programmable reference voltage generator, comprising:

a bandgap generation circuit for providing an operating voltage;

a first amplifier having a negative input terminal for receiving the operating voltage;

a second amplifier having a positive input terminal for receiving the operating voltage, a negative input terminal connected to a first node point and an output terminal connected to a second node point;

a first PMOS transistor having a source terminal and a substrate connected to a source voltage, a gate terminal connected to the output terminal of the first amplifier and a drain terminal connected to the positive input terminal of the first amplifier;

a second PMOS transistor having a source terminal and a substrate connected to the voltage source and the gate terminal connected to the output terminal of the first amplifier;

a third PMOS transistor having a source terminal and a substrate connected to the voltage source, and a gate terminal and a drain terminal connected to each other;

a fourth PMOS transistor having a source terminal and a substrate connected to the voltage source and a gate terminal connected to the gate terminal of the third PMOS transistor;

a fifth PMOS transistor having a source terminal and a substrate connected to the source voltage, and a gate terminal and a drain terminal connected to each other;

a sixth PMOS transistor having a source terminal and a substrate connected to the source voltage, a gate terminal connected to the drain terminal of the fifth PMOS transistor and a drain terminal connected to a fourth node point;

a first NMOS transistor having a source terminal and a substrate connected to a ground voltage, and a gate terminal and a drain terminal connected to each other and to the drain terminal of the second PMOS transistor;

a second NMOS transistor having a source terminal and a substrate connected to the ground, a gate terminal connected to the gate terminal of the first NMOS transistor, and a drain terminal connected to the drain terminal of the third PMOS transistor;

a third NMOS transistor having a source terminal and a substrate connected to the ground, and a gate terminal and a drain terminal connected to each other and to the drain terminal of the fourth PMOS transistor;

a fourth NMOS transistor having a source terminal and a substrate connected to the ground, a gate terminal connected to the gate terminal of the third NMOS transistor and a drain terminal connected to the drain terminal of the fifth PMOS transistor;

a fifth NMOS transistor having a source terminal and a substrate connected to the ground, a gate terminal connected to the gate terminal of the fourth PMOS transistor and a drain terminal connected to the third node point;

a first variable current source having an input terminal connected to the voltage source and output terminal connected to the drain terminal of the fourth PMOS transistor;

a second variable current source having an input terminal connected to the voltage source and an output terminal connected to the fourth node point;

a first resistor having a first terminal connected to the positive input terminal of the first amplifier and a second terminal connected to the ground;

a second resistor having a first terminal connected to the first node point and a second terminal connected to the second node point;

a third resistor having a first terminal connected to the first node point and a second terminal connected to the third node point;

a fourth resistor having a first terminal connected to the fourth node point and the second terminal connected to the ground;

wherein the first node point, the second node point, the third node point and the fourth node point are used for outputting a first reference voltage, a second reference voltage, a third reference voltage and a fourth reference voltage respectively.

2. The reference voltage generator of claim 1, wherein dimensional ratio between the first PMOS transistor and the second PMOS transistor is 4:1.

3. The reference voltage generator of claim 1, wherein dimensional ratio between the third PMOS transistor and the fourth PMOS transistor is 1:4.

4. The reference voltage generator of claim 1, wherein dimensional ratio between the fifth PMOS transistor and the sixth PMOS transistor is 4:½.

5. The reference voltage generator of claim 1, wherein dimensional ratio between the first NMOS transistor and the second NMOS transistor is 1:1.

6. The reference voltage generator of claim 1, wherein dimensional ratio for the third NMOS transistor, the fourth NMOS transistor and the fifth NMOS transistor is 4:4:1.

7. The reference voltage generator of claim 1, wherein the relationship between the first reference voltage, the second reference voltage and the third reference voltage is given by the formula: the first reference voltage=(the second reference voltage+the third reference voltage)/2.

8. The reference voltage generator of claim 1, wherein the first resistor has a resistance of about 25 KΩ.

9. The reference voltage generator of claim 1, wherein the second resistor and the third resistor both has a resistance of about 20 KΩ.

10. The reference voltage generator of claim 1, wherein the fourth resistor has a resistance of about 20 KΩ.

* * * * *